United States Patent [19]

Boesen

[11] Patent Number: 4,563,776

[45] Date of Patent: Jan. 14, 1986

[54] STADIUM COAT

[76] Inventor: Connie J. Boesen, 801 Bertch Ave., Waterloo, Iowa 50702

[21] Appl. No.: 646,466

[22] Filed: Sep. 4, 1984

[51] Int. Cl.[4] ..... A41D 3/02

[52] U.S. Cl. ..... 2/85; 2/94

[58] Field of Search ..... 2/85, 88, 93, 94

[56] References Cited

U.S. PATENT DOCUMENTS

| | | | |
|---|---|---|---|
| 33,910 | 12/1861 | Weiss | 2/88 |
| 1,316,469 | 9/1919 | Werner | 2/85 |
| 2,058,474 | 10/1936 | Long | 2/85 |
| 2,146,243 | 2/1939 | Aug | 2/85 |
| 2,235,812 | 3/1941 | Greenberg | 2/85 |
| 2,825,902 | 3/1958 | Breier | 2/93 |
| 2,911,648 | 11/1959 | Schanda-Seyferth | 2/69 |
| 4,055,153 | 11/1977 | Argento et al. | 2/93 |
| 4,068,314 | 1/1978 | Yellen et al. | 2/94 |
| 4,168,544 | 9/1979 | Kallman | 2/94 |
| 4,272,852 | 6/1981 | Bell | 2/94 |
| 4,307,470 | 12/1981 | Ezell | 2/108 |
| 4,351,066 | 10/1982 | Pearsall | 2/85 |
| 4,389,735 | 6/1983 | McLaughlin | 2/94 |
| 4,475,251 | 10/1984 | Hopkins | 2/85 |

OTHER PUBLICATIONS

McCalls—Mar. 1984, pp. 181-182.

*Primary Examiner*—Doris L. Troutman

*Attorney, Agent, or Firm*—Henderson & Sturm

[57] ABSTRACT

A garment having a front, back, sides, top and an open bottom. The top has closed shoulders thereon and an opening therebetween for receiving a person's head. A pair of straps extend over each shoulder, one end of each strap being permanently affixed to the back of the coat. Fasteners are attached to the other end of each of the straps. A pair of first fastener receiving structures are attached to a lower portion of the back for receiving each respective one of the fasteners and thereby holding the coat in a folded position when the fasteners are attached to the pair of first fastener receiving structures. A pair of second fastener receiving structures are attached to a top portion of the front of the coat, one just below each shoulder, for receiving respectives ones of the fasteners when the coat is being worn, whereby the straps can be stored unobtrusively while the coat is being worn. A handle is attached at each end thereof to an intermediate portion of each of the straps for permitting the folded coat to be easily carried from place to place.

5 Claims, 6 Drawing Figures

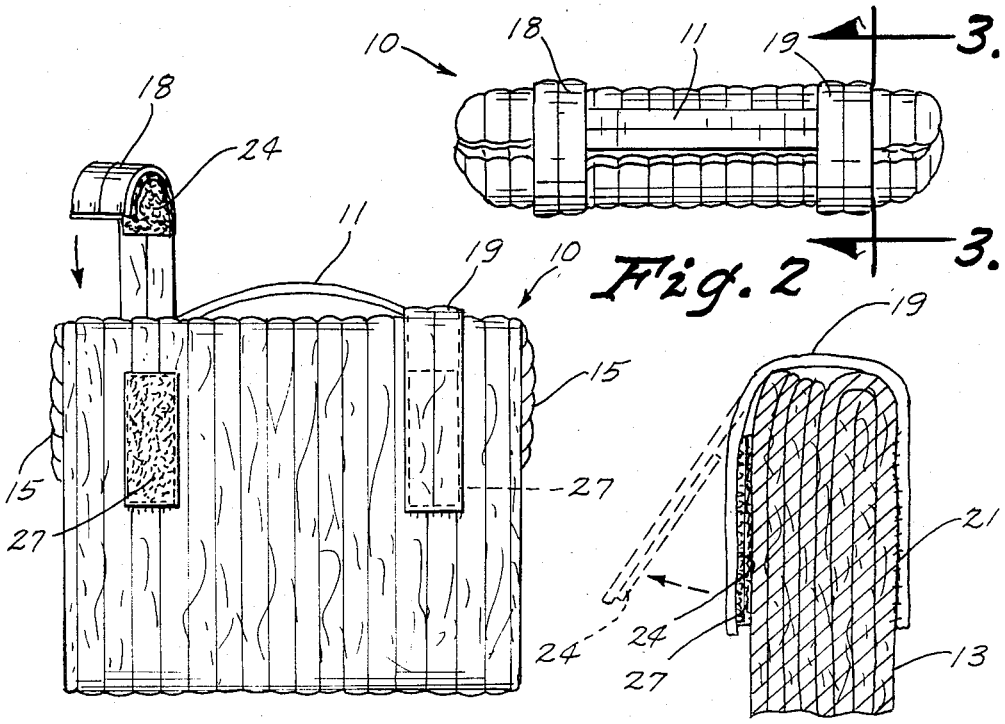
Fig. 2
Fig. 1
Fig. 3
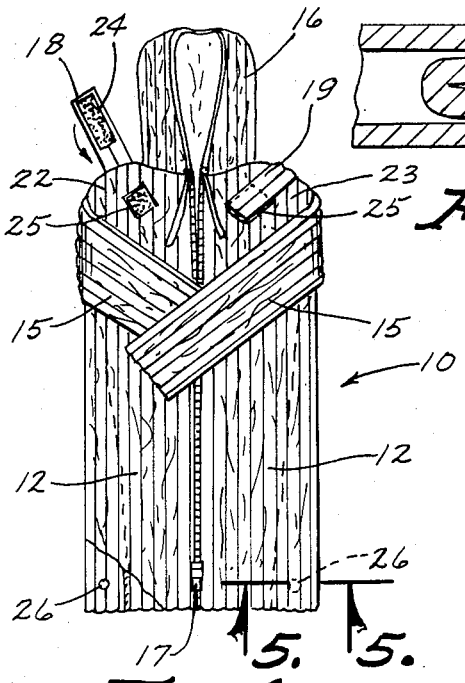
Fig. 4
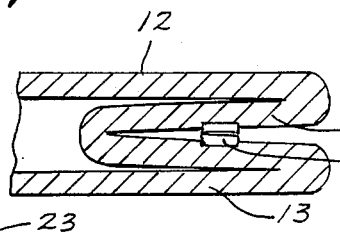
Fig. 5
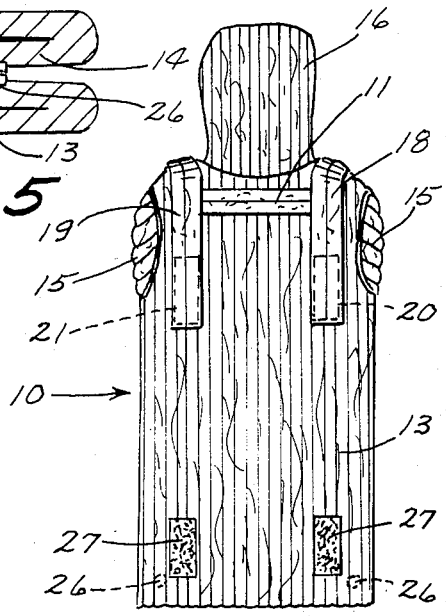
Fig. 6

STADIUM COAT

TECHNICAL FIELD

The present invention relates generally to a folding coat and more particularly to such a coat which is convertible to a cushion with a carrying handle.

BACKGROUND ART

A problem in attending football games or other athletic events in the fall of the year is that the weather is so unpredictable that it is difficult to dress properly for such outdoor events. The weather at the beginning of such event can be warm enough that light clothing is appropriate, and can turn to weather where warmer heavy or water repellant clothing is appropriate, or vice versa. Consequently, it is common for people to dress inappropriately for such events; or, as a precaution, to take extra clothing just in case the weather turns colder or inclement.

Stadium seats are also noted for being hard and uncomfortable, so stadium cushions are often taken, especially since such events can last for several hours.

Consequently, it can be readily appreciated that a large quantity of support equipment is often taken to outdoor events at stadiums. Besides the inconvenience of carrying such equipment to and from the stadium, there is a problem of where to store such additional clothes or equipment if it is not being used, since there is little space provided for each person in a crowded stadium.

There is therefore a need for equipment which will overcome the aforementioned problems.

DISCLOSURE OF THE INVENTION

The present invention relates to a garment having a front, back, sides, top and an open bottom. The top has closed shoulders thereon and an opening therebetween for receiving a person's head. A pair of straps extend over each shoulder, one end of each strap being permanently affixed to the back of the coat. Fasteners are attached to the other end of each of the straps. A pair of first fastener receiving structures are attached to a lower portion of the back for receiving each respective one of the fasteners and thereby holding the coat in a folded position when the fasteners are attached to the pair of first fastener receiving structures. A pair of second fastener receiving structures are attached to a top portion of the front of the coat, one just below each shoulder, for receiving respective ones of the fasteners when the coat is being worn, whereby the straps can be stored unobtrusively while the coat is being worn. A handle is attached at each end thereof to an intermediate portion of each of the straps for permitting the folded coat to be easily carried from place to place.

An object of the present invention is to provide a coat which is convertible into a sitting cushion.

Another object of the invention is to provide a coat which is convertible into a package easy to carry from place to place and having a handle thereon.

A further object is to provide a carrying handle for a folding coat which does not obstruct the usefulness of the coat while being worn, when the handle is not in use.

Other objects, advantages and novel features of the present invention will become apparent from the following detailed description of the invention when considered in conjunction with the accompanying drawings.

BRIEF DESCRIPTION OF THE DRAWINGS

FIG. 1 is a front elevational view of the stadium coat of the present invention in a folded position showing one VELCRO closure closed and another VELCRO closure open;

FIG. 2 is a top view of the present invention in a folded position;

FIG. 3 is an enlarged partial cross-sectional view taken along line 3—3 of FIG. 2;

FIG. 4 is a front elevational view of the present invention in an unfolded position with one VELCRO closure closed and one VELCRO closure open;

FIG. 5 is an enlarged partial cross-sectional view taken along line 5—5 of FIG. 4 showing snaps for selectively holding a side pleat in the coat; and FIG. 6 is a rear view of the present invention shown in the unfolded position.

BEST MODE FOR CARRYING OUT THE INVENTION

Referring now to the drawings, wherein like reference numerals designate identical or corresponding views throughout the several views, FIG. 1 shows a coat (10) folded into a cushion having a carrying handle (11) attached thereto.

The coat (10) is shown constructed of a quilted material. The material is basically two layers of nylon material with a polyester layer therebetween and having parallel stitching every inch or so. This type of material permits the coat to be easily folded into a cushion which is soft to sit on and yet does not wrinkle badly so that when it is desired to unfold the cusion into use as a coat, the coat will have an unwrinkled appearance. The coat is also well insulated and somewhat water repellant, yet allows the cloth to breath to permit perspiration to pass out through the cloth.

The coat (10) has front panels (12), a rear panel (13), side panels (14), sleeves (15) and a hood (16). A zipper (17) is provided for selectively opening the front of front panels (12).

Referring to FIG. 6, a pair of straps (18) and (19) are sewn to the rear panel (13) of the coat (10) by stitches (20) and (21). The straps (18) and (19) extend over the shoulders (22) and (23), respectively.

The other ends of straps (18) and (19) have VELCRO fasteners (24) sewn thereto. Mating VELCRO patches (25) are sewn to each of the shoulders (22) and (23) for holding straps (18) and (19) in place when the coat (10) is being worn, for example in the position shown by strap (19) in FIG. 4.

When it is desired to carry the coat (10) from place to place, the sides (14) are pleated as shown in FIGS. 4 and 5 and the snaps (26) are secured together. The zipper (17) is pulled down or up so that it is zippered up about half way to the top. One of the sleeves (15) is placed into the opening between the zipper (see FIG. 4) and the other sleeve (15) is folded to the position shown in FIG. 4. The hood is then folded inwardly and the VELCRO closures (24) are removed from VELCRO parts (25) so that the ends of the straps (18) and (19) are free. The coat is then folded in half and straps (18) and (19) are placed in the position shown in FIGS. 1–3 so that the VELCRO closures (24) are attached to VELCRO parts (27), which are sewn to the bottom rear panel (13) of the coat (10) as shown in FIGS. 1, 3 and 6. At that time, the handle (11) can be used to carry the coat (10) from place to place in a folded position.

It will readily be appreciated that the coat (10) can be used as a cushion to sit on in the folded position shown in FIGS. 1 and 2. It will also readily be appreciated that the cushion/coat is stored out of the way when used as a cushion until such time as it is desired to unfold it and use it as a coat again.

It will therefore be appreciated that the preferred embodiment of this invention shown in FIGS. 1–6 does indeed accomplish all of the aforementioned objects. Obviously, many modifications and variations of the present invention are possible in light of the above teachings. It is therefore to be understood that, within the scope of the appended claims, the invention may be practiced otherwise than as specifically described.

I claim:

1. A stadium coat comprising:

a garment having a front, back, sides, top and an open bottom;

the top having closed shoulders thereon and an opening therebetween for receiving a person's head;

a pair of straps, one extending over each shoulder, one end of each said strap being permanently affixed to the back of the coat;

fastener means attached to the other end of each of said straps;

a pair of first fastener receiving means attached to a lower portion of the back for receiving each respective one of said fastener means and hereby holding the coat in a folded position when said fastener means are attached to said pair of first fastener receiving means;

a pair of second fastener receiving means attached to a top portion of said front, one just below each shoulder, for receiving respective ones of said coat is being worn whereby the straps can be stored unobstrusively while the coat is being worn; and handle means attached at each end thereof to an intermediate portion of each of the straps for providing a handle when the coat is in the folded position thereof.

2. The stadium coat of claim 1 wherein said fastener means and said first and second pair of fastener receiving means is comprised of VELCRO.

3. The stadium coat of claim 2 wherein said coat includes sleeves and a hood.

4. The stadium coat of claim 3 wherein each of the sides include spaced apart mating holding means for holding the sides together in a pleated fashion.

5. The stadium coat of claim 4 wherein said holding means are snaps.

* * * * *